United States Patent [19]

Kilmer et al.

[11] 4,284,109

[45] Aug. 18, 1981

[54] ELECTRIC CONDUCTOR WRAPPING TOOL

[75] Inventors: Paul R. Kilmer, Leroy; Roger M. Bula, Reed City, both of Mich.

[73] Assignee: Cooper Industries, Inc., Houston, Tex.

[21] Appl. No.: 86,425

[22] Filed: Oct. 19, 1979

[51] Int. Cl.[3] ..... B21F 15/04

[52] U.S. Cl. ..... 140/122; 140/124

[58] Field of Search ..... 140/122, 124, 119; 192/0.094, 18 R

[56] References Cited

U.S. PATENT DOCUMENTS

| | | | |
|---|---|---|---|
| 2,927,741 | 3/1960 | Moore et al. | 242/7 |
| 3,172,517 | 3/1965 | Moore | 192/148 |
| 3,200,922 | 8/1965 | Allen | 192/18 R X |
| 3,219,067 | 11/1965 | Meyer | 140/124 |
| 3,464,527 | 9/1969 | Baker | 192/0.072 |
| 3,717,183 | 2/1973 | Coss | 140/124 |
| 3,903,936 | 9/1975 | Bergmann | 140/124 |

*Primary Examiner*—Richard B. Lazarus

*Attorney, Agent, or Firm*—Richards, Harris & Medlock

[57] ABSTRACT

In a hand-held power tool (10) for wrapping conductor around an electrical terminal, a drive means (14, 34 and 42) is selectively engaged with a clutch (58) mounted on a drive shaft (44) journaled within index means (62) in axial arrangement within a case (12). The drive means (14, 34 and 42) and index means (62) are secured to the case (12) by means of circular tongue and groove structure of radially stepped configuration. Resilient ring members (60) are frictionally engaged between the drive means (14, 34 and 42) and the drive shaft (44) to provide for gradual arrest of the drive means after disengagement of the clutch means (58) and stoppage of the drive shaft by the index means (62). A trigger (22) within the case (12) controls actuation of the drive means (14, 34 and 42) and engagement of the clutch means (58) therewith.

16 Claims, 7 Drawing Figures

ELECTRIC CONDUCTOR WRAPPING TOOL

TECHNICAL FIELD

The present invention relates in general to a hand-held power tool. More particularly, this invention concerns a power operated tool for wrapping conductor about an electrical terminal.

BACKGROUND ART

Various power driven tools have been developed for tightly wrapping electric conductor about electrical terminals to form mechanical, solderless electrical connections. Tools of this type generally include a rotary bit of hollow construction with a longitudinal recess therein for receiving the wire. The bit is selectively driven by a suitable motor and drive train housed within a case held by the operator of the tool. Some form of finger-operated switch is usually provided on the case for controlling the tool. Before the bit is positioned over the terminal, wire is inserted into the recess of the bit. The tool is actuated for a short interval to accomplish connection. Most of the conductor wrapping tools now in use also include an indexing mechanism which stops the bit in a predetermined angular orientation to facilitate positioning of the tool for the next wrapping cycle. Conductor wrapping tools are thus characterized by high speed operation over short intervals followed by abrupt stoppage on a repeated basis, a combination which presents considerable design and engineering problems.

The prior tools have been generally large and heavy, in addition to being noisy and costly. Size and weight, of course, are wearisome to an operator, while noise affects the operator productivity. Although prior electric conductor wrapping tools have not been unreliable as a whole, relatively frequent maintenance of a time-consuming and thus costly nature has been required to achieve satisfactory reliability.

The drive train of an electric conductor wrapping tool is one area in which especially severe wear occurs. Aside from intermittent operation of the motor, abrupt stoppage of the drive train to index the rotary bit can cause damage to the motor or its mounting and to the drive train components. It is thus desirable to provide for gradual arrest of the motor and drive train after indexing of the bit, however, the tools of the prior art which have included structure for this purpose have been unduly complex and inadquately controllable. Finally, those prior tools which can be used with more than one type of bit are capable of accommodating only a narrow range of bits. A need has thus arisen for a new and improved conductor wrapping tool.

DISCLOSURE OF INVENTION

The present invention comprises an improved conductor wrapping tool which overcomes the foregoing and other difficulties associated with the prior art. In accordance with the invention, there is provided a power tool wherein the drive components are mounted in a manner which reduces vibration, noise and misalignment. The drive components are arranged axially behind the rotary bit for more compact and lightweight construction. Plastic parts are used to reduce weight, increase life, reduce audible noise, and reduce electrical noise generated at the bit. Tongue and groove structure is utilized to support the complete drive system within the tool case and constrain it against rotation. Frictional drag control structure is coupled between the motor and drive train for gradually arresting rotation of the motor and speed reducer after each abrupt stoppage of the drive train upon completion of a wrapping cycle and indexing of the bit for the next cycle.

In accordance with more specific aspects of the invention, there is provided an electric conductor wrapping tool comprising a case housing a motor coupled to a rotary bit. The motor is drivingly connected to a speed reducer and the bit is mounted on a drive shaft extending to the speed reducer. A clutch mounted on the drive shaft is slidable therealong between a position in driving engagment with the speed reducer and one in stopping engagement with an indexer, through which the shaft is journaled. To effect rotation of the bit, the clutch and motor are actuated simultaneously by a trigger located in the handle portion of the case. Tongue and groove structure is utilized to support the drive system at two points in the case and to constrain it against rotation. Upon release of the trigger, the clutch disengages with the speed reducer first and then the clutch and indexer interengage to stop the bit in a predetermined angular position. O-rings or glands are frictionally connected between the drive shaft and speed reducer for gradually arresting the motor after indexing of the bit.

BRIEF DESCRIPTION OF DRAWINGS

A more complete understanding of the invention can be had by reference to the following Detailed Description in conjunction with the accompanying Drawings, wherein.

DETAILED DESCRIPTION

Figures 1, 2, 3, 4:
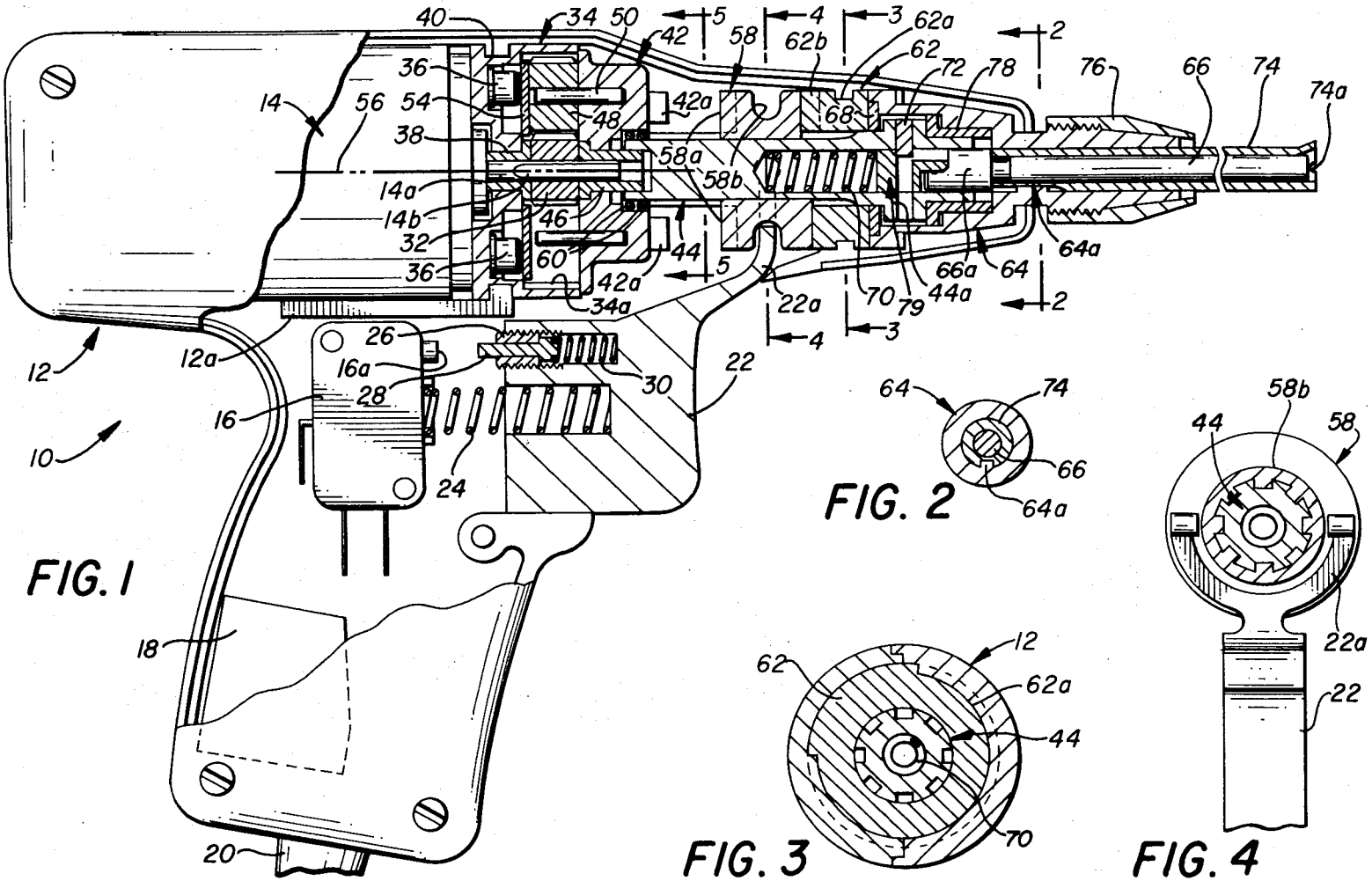
FIG. 1 is a side view (partially cut away) of a conductor wrapping tool incorporating the invention.
FIG. 2 is a sectional view taken along lines 2—2 of FIG. 1 in the direction of the arrows.
FIG. 3 is a sectional view taken along lines 3—3 of FIG. 1 in the direction of the arrows.
FIG. 4 is a sectional view taken along lines 4—4 of FIG. 1 in the direction of the arrows.

Referring now to the Drawings, wherein identical reference numerals designate like or corresponding parts throughout the several views, and particularly referring to FIG. 1 there is shown a tool 10 incorporating the invention. Tool 10 is of the power operated, hand-held type used for tightly wrapping a conductor wire around an electrical terminal to form a solderless connection. Tool 10 is thus an industrial unit employed in fabricating electronic components, subassemblies and the like. Tool 10 can be used with any gauge wire and a variety of bits including cut, strip and wrap bits. As will be more fully explained hereinafter, the drive components of tool 10 are axially arranged and supported in a manner which reduces vibration and misalignment, enhances reliability, and enables the tool to accommodate a wider variety of bits and wire sizes.

Conductor wrapping tool 10 includes a case 12 which houses a motor 14 and the remainder of the components. Case 12 is preferably constructed of high impact plastic, and may comprise left and right sections fastened together by fasteners as shown in FIG. 1. Any suitable type of motor can be utilized; however, in the preferred embodiment, motor 14 comprises a DC permanent magnet motor of compact size developing relatively high torque. The motor 14 is connected via switch 16 to a circuit board 18, which receives AC power from a cord 20 extending from the bottom of the pistol grip portion of case 12. Circuit board 18 includes appropriate rectifier circuitry for converting the voltage into a form usable by motor 14. Conventional wiring (not shown) interconnects motor 14, switch 16, circuit board 18 and cord 20.

Actuation of motor 14 is controlled by a manual trigger 22 moveably supported in the handle portion of case 12. A spring 24 is positioned between trigger 22 and switch 16, or between the trigger and a portion of case 12, for biasing the trigger outwardly away from the trigger. A threaded bushing 26 with a plunger 28 slideably carried in bore extending therethrough is mounted in an opening provided in the rear of trigger 22. Spring 30 biases the plunger 28 outwardly from trigger 22 toward switch 16. Bushing 26 and plunger 28 are positioned to engage actuator 16*a* of motor switch 16 when trigger 22 is pulled. The purpose of spring 30 is to absorb rearward motion of trigger 22 beyond the point at which switch actuator 16*a* is depressed to its limit by plunger 28. Adjustable nut 26, plunger 28 and spring 30 thus protect switch 16 from damage due to overtravel of trigger 22, and produce synchronization between actuation of motor 14 and movement of the trigger.

Motor 14 includes a forwardly extending shaft 14*a* on which a pinion gear 32 is supported. Pinion gear 32 is positioned to motor shaft 14*a* by a pair of flats 14*b* located on opposite sides of the shaft. If desired, gear 32 can be constructed of suitable metal. Pinion gear 32 is thus mounted for rotation with shaft 14*a* but slideable thereon for purposes of alignment or equivalent driving means.

A ring gear bracket 34 is attached by fasteners 36 directly to motor 14 in a surrounding relationship with motor shaft 14*a*. A flange bearing 38 is provided between shaft 14*a* and the cup-shaped bracket 34. A groove 40 is formed in bracket 34 for engagement with a corresponding tongue formed in case 12 and case partition 12*a*. Groove 40 and the corresponding parts of case 12 and case partition 12*a* are stepped at circumferentially spaced points thereabout to prevent rotation of motor 14 and the ring gear bracket 34 of tool 10. Groove 40 is similar in construction to groove 62*a* of indexer 62 of FIG. 3 shown herein. The rear end of motor 14 is seated or positioned between the top of case 12 and case partition 12*a*. It will thus be understood that the rear end of the drive train in tool 10 is fixedly secured by a tongue and groove arrangement formed integrally between case 12 and ring gear bracket 34.

Figure 5:
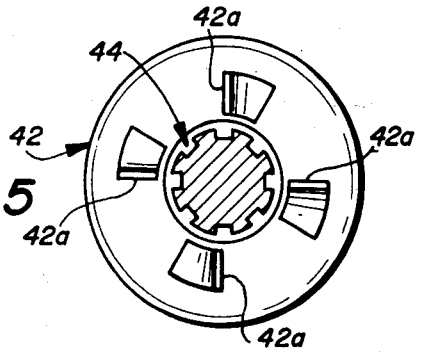
FIG. 5 is a sectional view taken along lines 5—5 of FIG. 1 in the direction of the arrows.

An idler gear plate 42 is radially supported on the front end of motor shaft 14*a* as well as the rear end of drive shaft 44 by flange bearing 46. Three idler gears 48, each of which is mounted on a pin 50 attached to plate 42, are enmeshed between ring gear 34*a* on bracket 34 and pinion gear 32. If desired, gears 48 can be constructed of suitable metal. A circular plate 54 is positioned adjacent to idler gears 48 to prevent contact with screws 36. A set of pawls 42*a* extend outwardly from the front face of idler gear plate 42. As is best seen in FIG. 5, in the preferred configuration four pawls 42*a* extend radially from the center of plate 42 at 90° intervals thereabout. It will thus be apparent that idler gear plate 42 is supported for rotation about axis 56 and functions as a speed reducer for motor 14.

Figure 7:
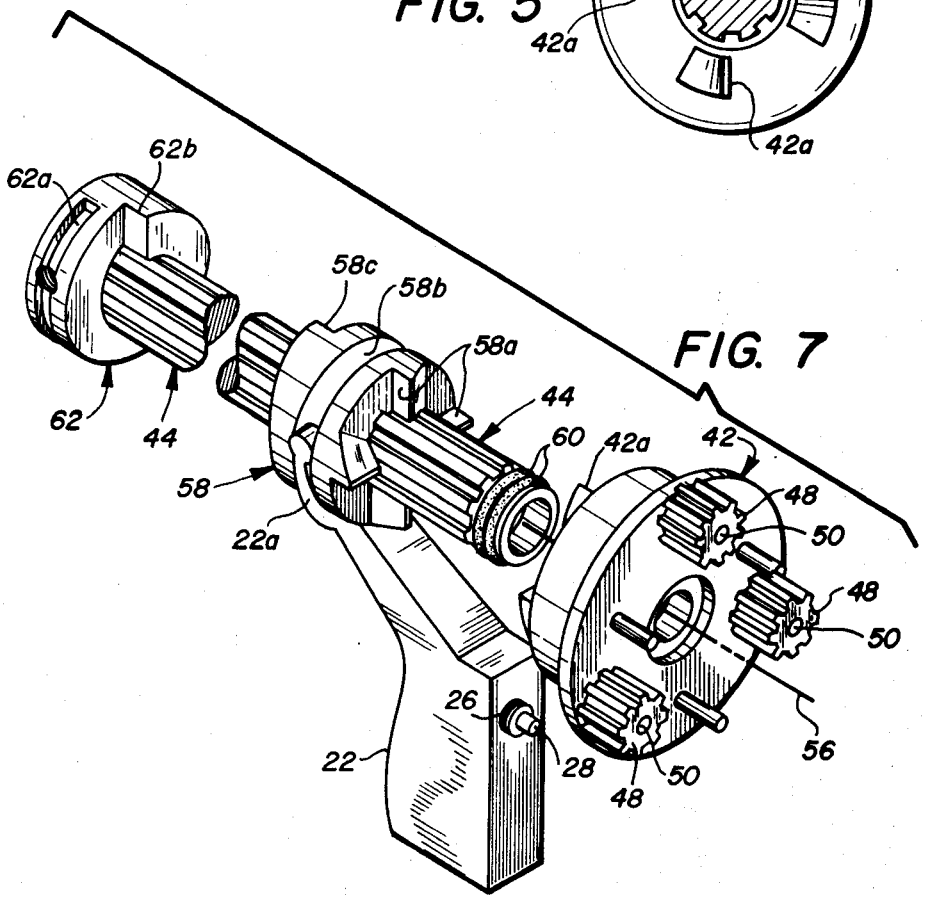
FIG. 7 is an exploded perspective view of some of the components of the invention.

A clutch 58 is positioned on drive shaft 44 in front of idler gear plate 42. That portion of drive shaft 44 extending forwardly from idler gear plate 42 is splined so that clutch 58 is constrained for rotation therewith but longitudinally slideable thereon. The rear face of clutch 58 includes clutch pawls 58*a*, which are best seen in FIG. 7. Trigger 22 is connected directly to clutch 58 by means of trigger yoke 22*a* received in circular groove 58*b* of the clutch as shown in FIG. 4. Actuation of trigger 22 will thus cause clutch 58 to move along drive shaft 44 until pawls 42*a* and 58*a* interengage. Plunger 28 in trigger 22 should be adjusted so that actuation of motor 14 occurs simultaneously with engagement between idler gear plate 42 and clutch 58.

A plurality of resilient O-rings 60 are frictionally engaged between idler gear plate 42 and the smooth rear end of shaft 44. Two O-rings 60 are shown for purposes of illustration, although any suitable number can be utilized in tool 10. Any type of elastomeric material drag could also be used in place of O-rings 60. O-rings 60 function to apply a control torque to the drive shaft to allow the clutch face 58*c* to index with indexer face 62*b* after disengagement of pawls 42*a* and 58*a*. Also, the O-ring allow the motor and gear plate to slow down at a rate faster upon completion of indexing. The amount of torque exerted by O-rings 60 can be controlled by changing their number or size. O-rings 60 also compensate for tolerance stackup along axis 56 which could cause misalignment and undue water of drive train components and gives a faster time cycle in tool 10. It will thus be understood that provision of O-rings 60 comprises a significant feature of the present invention.

Referring to FIGS. 1 and 3, drive shaft 44 is journaled for rotation in bearing 78 and passes through stationary indexer 62 located in front of clutch 58. Indexer 62 includes a circumferential groove 62*a* of stepped configuration as is best seen in FIG. 3. Groove 62*a* receives a corresponding tongue formed integrally in case 12 to secure indexer 62 against rotation. The forward end of the drive train in tool 10 is thus supported by a tonge and groove arrangement similar to that utilized to support the rear of the drive train at motor 14 and ring gear bracket 34. The rear face of indexer 62 defines a helical pawl 62*b* positioned for engagement with a corresponding helical pawl 58*c* formed on the front face of clutch 58. Indexer 62 functions to index the clutch 58 and drive shaft 44 release of trigger 22.

A shaft 44 drives a bit 66 and is contained radially and axially by bushing 78 and sleeve 74 which are held in position by collet 64. Collet 64 is preferably formed of plastic to reduce electrical noise transfer to components being connected. A thrust bearing 68 is provided between the shaft 44 and indexer 62. Bit 66 is slideable within drive shaft 44 and sleeve 74, and is biased outwardly by a spring 70 located inside the drive shaft which engages pawl 66*a* located at the inner end of the bit. Bit pawl 79 includes a bore which corresponds with cross bore 44*a* in drive shaft 44. Bit 66 is thus slideable inwardly of drive shaft 44 during the wrapping operation when pin 72 is placed in the upper end of cross bore 44*a* as shown in FIG. 1. If desired, bit 66 can be immobilized within drive shaft 44 by placement of pin 72 in the lower end of cross bore 44*a*. Bit 66 is surrounded by a sleeve 74 which is attached to collet 64 by a friction fit collet nut 76. Sleeve 74 is received by an index rib 64*a* for proper positioning relative to collet 64 and bit 66. Conductor to be wrapped around a terminal is received in a groove 74*a* within sleeve 74. If desired, a bearing 78 can be removed from between the front end of drive shaft 44 and collet 64.

Figure 6:
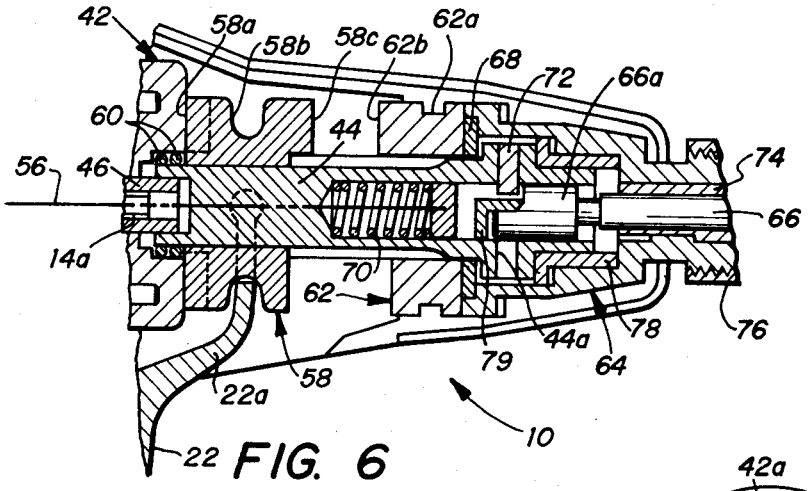
FIG. 6 is a side view (partially cut away) of a portion of the tool showing certain parts in different operational positions.

FIG. 6 illustrates the drive train components of tool 10 upon actuation of trigger 22. Pawls 58*a* on clutch 58 engage pawls 42*a* on idler gear plate 42 as plunger 28 contacts switch 16 to actuate motor 14. Plate 42, drive shaft 44, and clutch 58 thus rotate about axis 56 to drive bit 66 supported by sleeve 74. As the conductor wraps around the terminal, bit 66 is forced inside sleeve 74 against spring 70 so that the resulting wrap of wire is longitudinally tight. Spring 70 is selected to apply the amount of back force required in accordance with the gauge of wire being wrapped. It will be noted that pin 72 is in the upper end of cross bore 44*a* so that bit 66 can be forced inwardly against spring 70.

After completion of the wrapping cycle, trigger 22 is released while drive shaft 44 and clutch 58 continue rotating until stopped by indexer 62. Bit 66 is thus halted in the proper position almost immediately after release of trigger 22. Shaft 14*a* of motor 14 and idler gear plate 42, however, continue revolving for a moment until overcome by the controlled torque of O-rings 60.

From the foregoing, it will be apparent that the present invention comprises an improved electric conductor wrapping tool having several advantages. The drive train components are mounted axially behind the rotary bit to enable more compact and lightweight construction. Advantages over the prior art include the drive train being supported at both ends within the tool case by integrally formed tongue and groove structure. The motor is coupled to the drive shaft in a manner which permits controlled overrun of the motor upon indexing the drive shaft after completion of a wrapping cycle. Other advantages will suggest themselves to those skilled in the art.

Although particular embodiments of the invention have been illustrated in the accompanying Drawings and described in the foregoing Detailed Description, it will be understood that the invention is not limited to the embodiments disclosed, but is intended to embrace any alternatives, modifications, rearrangements and/or substitutions of elements as fall within the scope of the invention.

We claim:

1. In a conductor wrapping tool of the type having drive means selectively engageable with clutch means mounted on a drive shaft for effecting rotation of a bit connected to the drive shaft, and having index means for stopping the bit in a predetermined position after disengagement of the drive means and clutch means, the improvement which comprises:

at least one separate resilient member means frictionally engaged between the drive means and drive shaft for applying controlled torque such that the index position is achieved and the drive means is gradually arrested after disengagement from the clutch means and stoppage of the drive shaft.

2. The tool of claim 1, wherein said resilient means comprises:

a plurality of elastomeric members.

3. The tool of claim 1, wherein the drive means, clutch means, drive shaft and index means are housed within a case, and further including:

means formed in the case for supporting said drive means and index means therein and for constraining said drive means and index means against rotation.

4. The tool according to claim 3, wherein said support means comprises:

two circular tongues of radially stepped configurations formed in the case, one of said tongues being located adjacent to the drive means and the other tongue being located adjacent to the index means;

said drive means and index means each including a corresponding groove for receiving said tongues.

5. In a conductor wrapping tool of the type having a case housing drive means selectively engageable with a drive shaft connected to a rotary bit, and having index means for stopping the bit in a predetermined position after disengagement of the drive means and drive shaft, the improvement which comprises:

circular tongues of radially stepped configurations formed in the case;

corresponding internal members each having a corresponding groove formed therein for receiving said tongues in rotation-opposing engagement therein; and at least one separate elastomeric member means frictionally engaged between the drive means and drive shaft for applying controlled torque such that the drive means is gradually arrested after driving disengagement from the drive shaft and stoppage of the bit.

6. The tool according to claim 5, wherein said elastomeric member means comprises:

a plurality of elastomeric members.

7. A conductor wrapping tool, comprising:

a case;

a drive shaft positioned inside said case;

drive means located at one end of said drive shaft, said drive means being supported by said case;

a bit connected to the opposite end of said drive shaft;

index means secured to said case for rotatably positioning said drive shaft;

clutch means mounted on said drive shaft for rotation therewith and movement therealong between a first position in driving engagement with the drive means and a second position in stopping engagement with the index means;

means mounted in said case for controlling actuation of the drive means and clutch means; and separate controlled torque means frictionally engaged between said drive means and drive shaft after indexing position has been achieved for gradually arresting said drive means after disengagement from the clutch means and stoppage of said drive shaft.

8. The tool of claim 7, wherein said drive means comprises:

a motor with an output shaft;

a pinion gear mounted on the output shaft of said motor;

a cup-shaped bracket with a ring gear therein affixed to said motor such that the ring gear surrounds said pinion gear in spaced relationship therewith; and speed reducing means coupled to said pinion gear and the ring gear on said bracket for engagement with said clutch means.

9. The tool of claim 7, wherein said means for mounting said index means within said case comprises:

a circular tongue of radially stepped configuration formed in said case adjacent to said index means;

said index means including a corresponding groove therein such that said index means is constrained against rotation relative to said case.

10. The tool of claim 7, wherein said means for mounting said drive means within said case comprises:

a circular tongue of radially stepped configuration formed in said case adjacent to said drive means;

said drive means including a corresponding groove for receiving said tongue such that said drive means is constrained against rotation relative to said case.

11. The tool of claim 7, wherein said controlled torque means comprises:

a plurality of elastomeric members.

12. The tool of claim 7, wherein said control means comprises:

switch means for actuating or deactuating said drive means;

a trigger moveably mounted in said case for movement into and out of engagement with said switch means, said trigger being connected to said clutch means; and resilient means positioned in said trigger for adjusting contact between said trigger and switch means.

13. A conductor wrapping tool, which comprises:

a case;

a drive shaft positioned inside said case;

drive means located at one end of said drive shaft;

means including circular, radially stepped tongue and groove structure formed in said drive means and adjacent case for constraining said drive means against rotation relative to said case;

a bit connected to the opposite end of said drive shaft;

index means positioning said drive shaft for rotation;

means including circular, radially stepped tongue and groove structure formed in said index means and adjacent case for constraining said index means against rotation relative to said case;

clutch means mounted for rotation with said drive shaft and movement therealong between a first position in driving engagement with said drive means and a second position in stopping engagement with said index means;

means mounted in said case for controlling actuation of said drive means and clutch means; and separate controlled torque means frictionally engaged between said drive means and drive shaft after indexing position has been achieved for gradually arresting said drive means after disengagement from the clutch means and stoppage of said drive shaft.

14. The tool of claim 13, wherein said drive means comprises:

a motor with an output shaft;

a pinion gear mounted on the output shaft of said motor;

a cup-shaped bracket with a ring gear therein affixed to said motor such that the ring gear surrounds said pinion gear in spaced relationship therewith; and speed reducing means coupled to said pinion gear and the ring gear on said bracket for selectively engaging said clutch means.

15. The tool of claim 13, wherein said control means comprises:

switch means for actuating or deactuating said drive means;

a trigger moveably mounted in said case for movement into and out of engagement with said switch means, said trigger being connected to said clutch means; and resilient means positioned in said trigger for adjusting contact between said trigger and switch means.

16. The tool according the claim 13, wherein said controlled torque means comprises:

at least one elastomeric ring member.

* * * * *